United States Patent [19]

Dareing

[11] 4,240,506

[45] Dec. 23, 1980

[54] DOWNHOLE RISER ASSEMBLY

[75] Inventor: Donald W. Dareing, Houston, Tex.

[73] Assignee: Conoco, Inc., Ponca City, Okla.

[21] Appl. No.: 13,768

[22] Filed: Feb. 21, 1979

[51] Int. Cl.[3] ..... E21B 17/01

[52] U.S. Cl. ..... 166/367; 175/7; 405/195

[58] Field of Search ..... 175/7; 166/367, 359, 166/355, 350; 405/195, 169, 170

[56] References Cited

U.S. PATENT DOCUMENTS

| | | | |
|---|---|---|---|
| 3,142,344 | 7/1964 | Otteman et al. | 166/359 |
| 3,516,488 | 6/1970 | Joubert et al. | 166/359 |
| 4,053,022 | 10/1977 | Mercier | 175/7 |
| 4,126,183 | 11/1978 | Walker | 166/364 |

*Primary Examiner*—William F. Pate, III

*Attorney, Agent, or Firm*—A. Joe Reinert

[57] ABSTRACT

A downhole riser assembly includes a tubular casing embedded in the ocean floor, said casing having a constant internal diameter and an upper end extending above said ocean floor. A tubular riser pipe is disposed in the casing and has an upper end connected to a floating vessel which may be a tension leg platform. The casing and riser are rigidly connected at a considerable distance below the ocean floor, said distance being on the order of 100 feet. When the floating structure is laterally displaced from a position directly above the casing, the riser pipe contacts the upper end of the casing. This contact limits the lateral deflection of the riser at the ocean floor and thereby limits the stresses in the riser. The distance between the upper end of the casing and the downhole connection between the casing and the riser, and the diameter of the casing are such that the riser has a rotational stiffness, adjacent the upper end of the casing, within a range such that both a maximum design maximum stress and a maximum design bottom slope of said riser are not exceeded when said riser is subjected to maximum design loading conditions. An alternative embodiment of the present invention provides a lateral support means for connecting the riser and the casing adjacent the upper end of the casing for restricting lateral movement of the riser.

21 Claims, 15 Drawing Figures

DOWNHOLE RISER ASSEMBLY

BACKGROUND OF THE INVENTION

1. Field of the Invention

This invention relates generally to subsea connections for marine risers from a subsea well.

2. Description of the Prior Art (Prior Art Statement)

The following statement is intended to be a Prior Art Statement in compliance with the guidance and requirements of 37 C.F.R. §§ 1.56, 1.97 and 1.98.

U.S. Pat. No. 3,559,410 to Blenkarn et al. discloses a tension leg for anchoring a tension leg platform, said tension leg having a rigid connection of the riser at the ocean floor, with a ring type structure (see 52 and 54 of FIG. 3) for limiting lateral movement of the riser and thereby limiting stresses in the riser at the ocean floor connection. Blenkarn et al. does not disclose a rigid mounting of the riser downhole within the casing below the ocean floor and the use of the upper end of the casing as a means for allowing limited lateral deflection of the riser at the ocean floor.

U.S. Pat. Nos. 3,142,343 and 3,142,344, both to Otteman et al., each disclose a tiltable collar 27 located above an upper end 36 of a casing 26 within which a riser pipe 34 is disposed. The riser 34 contacts upper end 36 of casing 26 and contacts the tiltable collar 27 to limit lateral movement of riser 34 and thereby limit stresses within the riser. Also, FIG. 2 of Pat. No. 3,142,344 shows a rigid collar 27*a* having a flared lip 29. Neither of those references discloses a rigid mounting of the riser downhole within the casing below the ocean floor, nor do they disclose the use of the upper end of the casing alone for limiting lateral deflection of the riser at the ocean floor, with the riser being free of contact with any other structure between the contact with the upper end 36 of casing 26 and the contact with the floating vessel.

U.S. Pat. No. 3,670,507 to Mott et al., No. 3,618,679 to Crooke, No. 3,556,210 to Johnson, No. 3,496,898 to Morgan, No. 3,403,728 to Richardson et al., No. 3,189,372 to Johnson and No. 3,017,934 to Rhodes et al. also relate to the reduction of stresses in marine risers and the like.

It is seen from these references that the prior art has recognized the need for a connection between the riser pipe and the subsea well which will limit the stresses to which the riser is subjected when the floating structure to which the riser is attached is tossed about by wind and waves. The present invention provides an improved and simplified connection which accomplishes this result.

SUMMARY OF THE INVENTION

A downhole riser assembly includes a tubular casing embedded in the ocean floor, said casing having a constant internal diameter and an upper end extending above said ocean floor. A tubular riser pipe is disposed in the casing and has an upper end connected to a floating vessel which may be a tension leg platform. The casing and riser are rigidly connected at a considerable distance below the ocean floor, said distance being on the order of 100 feet. When the floating structure is laterally displaced from a position directly above the casing, the riser pipe contacts the upper end of the casing. This contact limits the lateral deflection of the riser at the ocean floor and thereby limits the stresses in the riser. The distance between the upper end of the casing and the downhole connection between the casing and riser, and the diameter of the casing are such that the riser has a rotational stiffness, adjacent the upper end of the casing, within a range such that both a maximum design stress and a maximum bottom slope of said riser are not exceeded when said riser is subjected to maximum design loading conditions. An alternative embodiment of the present invention provides a lateral support means for connecting the riser and the casing adjacent the upper end of the casing for restricting lateral movement of the riser.

It is, therefore, a general object of the present invention to provide an improved connection between a marine riser and a subsea well.

Another object of the present invention is the provision of a riser assembly having a downhole connection between the casing and the riser.

And another object of the present invention is the provision of a riser assembly wherein lateral movement of the riser at the ocean floor is limited by contact with the upper end of the casing, said riser being free from contact with any other structure between the contact with the upper end of the casing and a contact with the floating vessel.

Other and further objects, features and advantages of the present invention will be apparent to those skilled in the art upon a reading of the following disclosure in conjunction with the accompanying drawings.

BRIEF DESCRIPTION OF THE DRAWINGS

FIG. 9 is a schematic elevation illustration of an alternative embodiment of the downhole riser assembly of the present invention.

DETAILED DESCRIPTION OF THE PREFERRED EMBODIMENT

Figure 1:
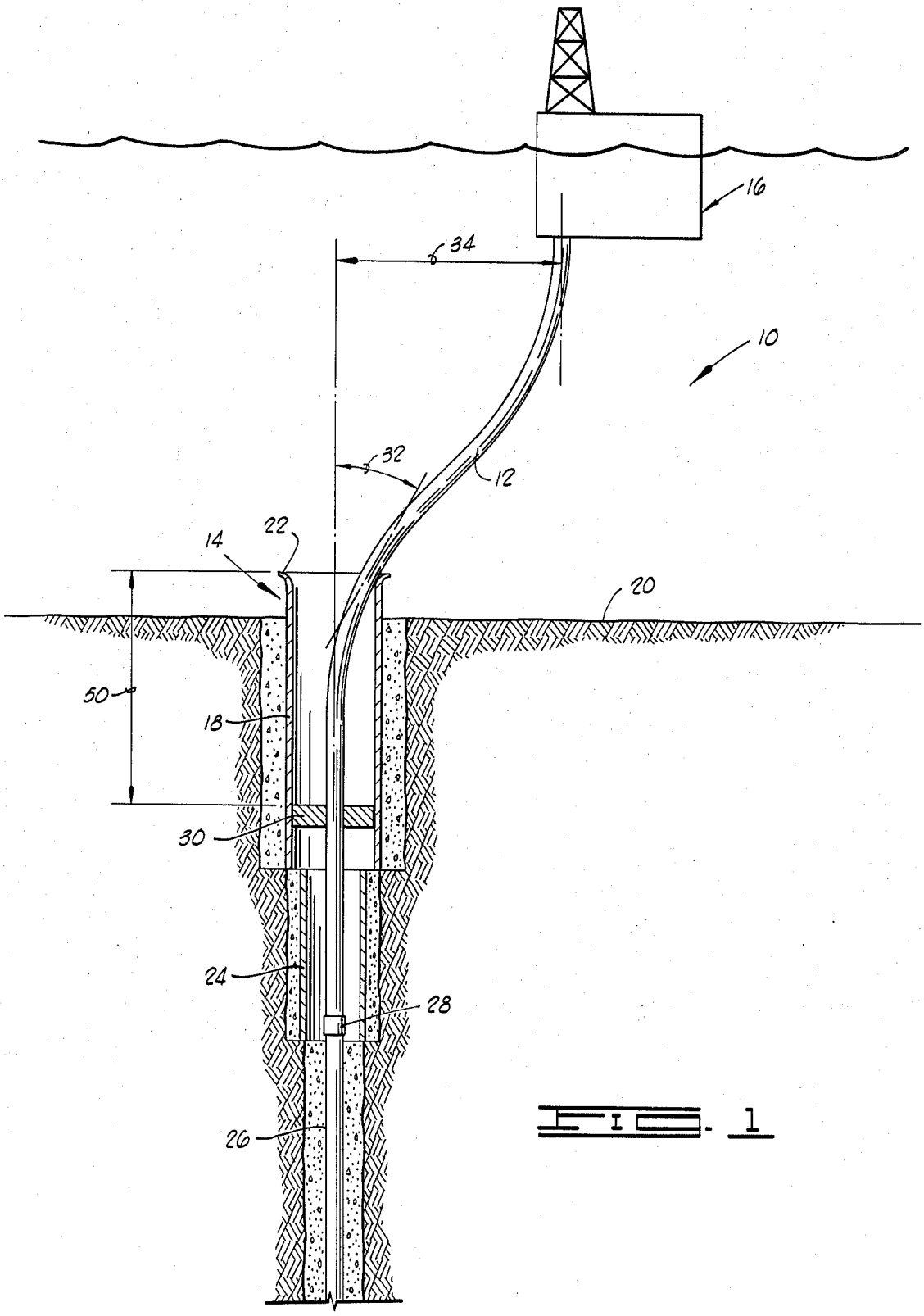
FIG. 1 is a schematic elevation illustration of the construction of the downhole riser assembly.

Referring now to the drawings, and particularly to FIG. 1, the downhole riser assembly of the present invention is shown and generally designated by the numeral 10. A riser pipe 12 connects a subsea or underwater well 14 with a floating structure 16. The specific embodiment of the invention disclosed below has been designed for use with a tension leg platform type of floating structure, although the invention is not limited to that application.

Subsea well 14 includes an upper casing portion or tubular member 18, which is embedded in the ocean floor 20 and cemented in place. A flared upper end 22 of upper casing portion 18 extends above the ocean floor 20. An intermediate casing portion 24, of diameter smaller then upper casing 18, is cemented in place below upper casing 18. A lower casing portion 26, of diameter smaller than intermediate casing 24, is cemented in place below intermediate casing 24.

The riser pipe 12, which is generally of the same diameter as lower casing 26, is connected at its lower end to lower casing 26 by coupling 28, or other suitable connecting means providing fluid communication between riser 12 and lower casing 26.

Riser pipe 12 is rigidly connected to upper casing portion 18 by casing hanger 30, and an upper end of riser pipe 12 is connected to floating structure 16.

The rigid connection at casing hanger 30 is such that riser pipe 12 is vertically contilevered above casing hanger 30 which may also be referred to as a lower connecting means.

In one specific embodiment of the present invention, the upper casing 18 has a diameter of 36 inches, while the lower casing 26 and riser 12 have an outer diameter of 9⅝ inches. After the well 14 is completed, the riser pipe 12 is connected between well 14 and floating structure 16. The riser 12 is then generally filled with mud and a production tubing (not shown) having a 5½ inch outer diameter is run into riser 12 down to the location of the producing zone of the well at which point the lower casing 26 has been perforated. It is the production tubing which actually carries the oil to the floating structure 16.

When the floating structure 16 is offset from a position directly above well 14, bending stresses are imposed upon riser 12 and the production tubing disposed therein, with the stresses generally being the most severe at that point near the ocean floor 20 where the lateral deflection of riser 12 is limited.

Several tool companies have developed flexible tool joints for relieving the stresses in the riser 12 itself, but such flexible joints tend to allow excessive bending at the ocean floor connection. This excessive bending can subject the production tubing carried by the riser 12 to severe bending stresses. Bending of the riser 12 and the production tubing at this point of lateral support near the ocean floor is often referred to as "dog leg" bending.

The bending stresses in the riser 12 near the ocean floor 20 depend upon the rotational stiffness (ft-lb/deg) of the riser 12 adjacent the upper end 22 of upper casing 18. As that rotational stiffness is increased, the angle of deflection or slope 32 of riser 12 at the flared lip 22 of upper casing 18 is decreased, which is desirable; the maximum stress on riser 12 for a given offset distance 34 of floating structure 16 is, however, increased, which is undesirable.

For given design conditions, which include a maximum value of offset 34, it is then necessary to reach a practical balance between minimizing stress imposed on riser 12 and minimizing the slope 32. An acceptable range for the rotational stiffness of riser 12 may be determined in the manner illustrated in FIG. 2.

Figure 2:
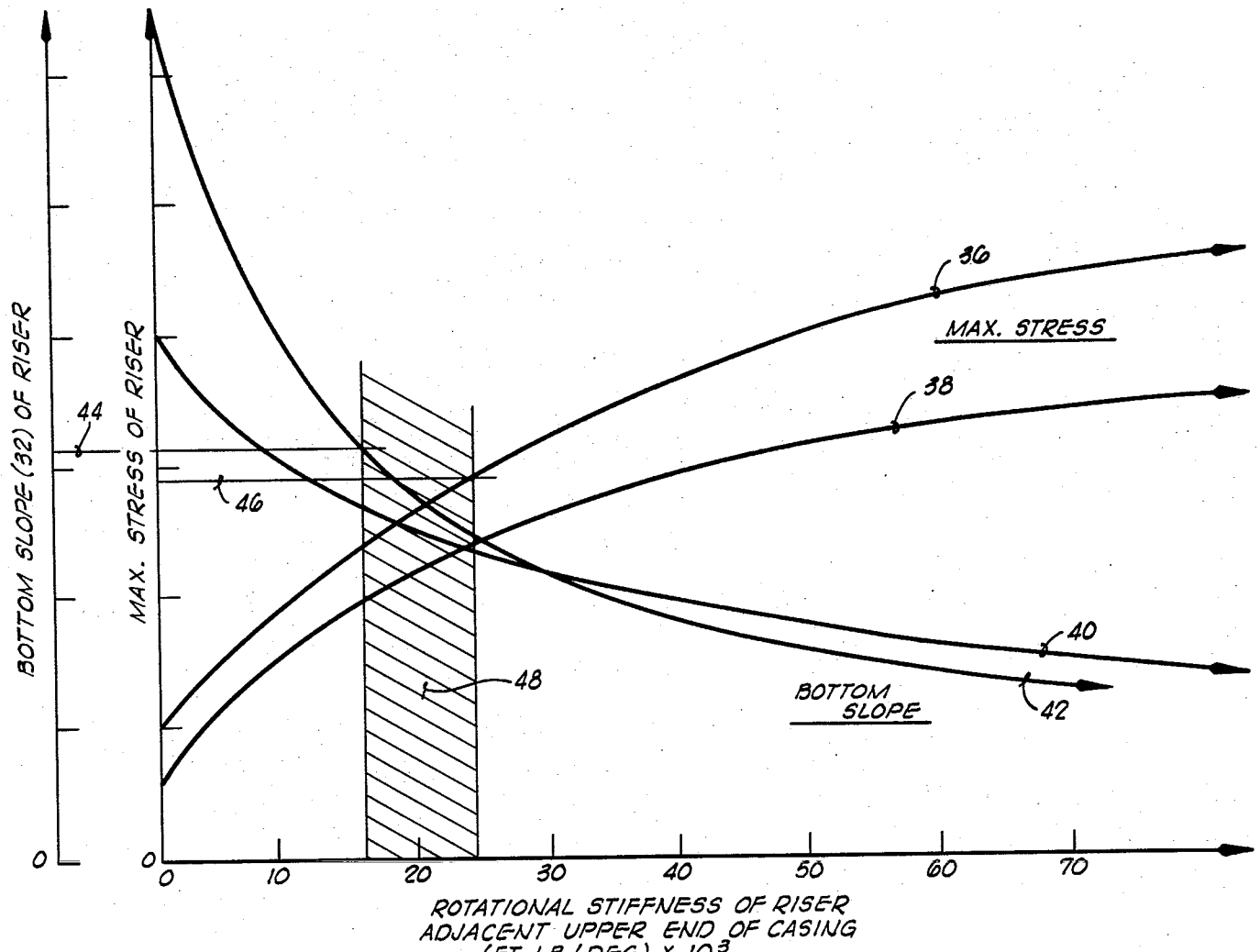
FIG. 2 is a graphic illustration of the manner in which the desired range of rotational stiffness of the riser adjacent the upper end of the casing is determined.

FIG. 2 graphically illustrates the bottom slope 32 of riser 12, and and maximum stress in riser 12, as a function of the rotational stiffness of riser 12 adjacent the upper end of casing 18.

Upper and lower curves 36 and 38, respectively, are shown for the maximum stress. Curves 36 and 38 represent the maximum stress in riser 12 for upper and lower design values of the axial tension exerted on riser 12. Similarly, upper and lower curves 40 and 42 are shown for the bottom slope 32 of riser 12.

The maximum stress which may be allowed in riser 12 will, of course, be determined by the material from which the riser 12 is constructed. The maximum bottom slope 32 which may be allowed will depend on the degree of bending the production tubing can withstand and through which downhole tools and the like may be successfully run. It will be appreciated that these values will vary between the various applications upon which the present invention may be used.

For example, if a maximum design bottom slope 32 is indicated by line 44, and a maximum design stress of riser 12 is indicated by line 46, then the desired range of rotational stiffness would be that spanned by shaded area 48.

It has been determined that the major factors contributing to the rotational stiffness of riser 12 adjacent upper end 22 of casing 18, aside from the cross-sectional dimensions of riser 12 and the axial tension in riser 12, are the distance 50 between upper end 22 and casing hanger 30, and the internal diameter of casing 18.

For a 9⅝ inch outside diameter riser pipe 12 having a wall thickness of 0.472 inches and with a nominal axial tension of 60,000 lbs., it has been determined that the optimum length of distance 50 is approximately 100 feet and the optimum internal diameter of casing 18 is approximately 36 inches.

The variations in maximum stress of riser 12, bottom slope 32, and rotational stiffness of riser 12 near upper end 22 in response to variation of casing length 50 above casing hanger 30 and in response to variation of the internal diameter of casing 18 are illustrated in FIGS. 3–8.

FIGS. 3–8 are based upon a design situation where the nominal values of the various relevant input parameters were as follows:

TABLE #1

| | Variable | Nominal Value |
|---|---|---|
| 1. | riser O.D. | 9.625 inch |
| 2. | riser thickness | 0.472 inch |
| 3. | offset (34) | 30 feet |
| 4. | axial tension of riser | 60,000 lb. |
| 5. | percent max. steady current crossflow | 66.67 |
| 6. | drag coefficient | 1.0 |

TABLE #1-continued

| | Variable | Nominal Value |
|---|---|---|
| 7. | casing length (50) above hanger | 100 feet |
| 8. | casing I.D. | 36 inches |
| 9. | riser/casing angular misalignment | 0 deg. |
| 10. | riser/casing lateral misalignment | 0 inch |
| 11. | wave height | 57.42 feet |
| 12. | wave period | 15 sec. |

Figure 3:
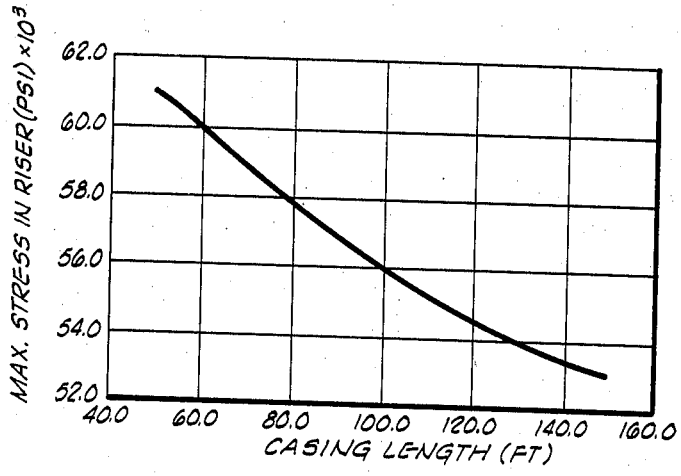
FIG. 3 graphically illustrates maximum stress in the riser as a function of casing length 50 for the assembly of FIG. 1.
Figure 4:
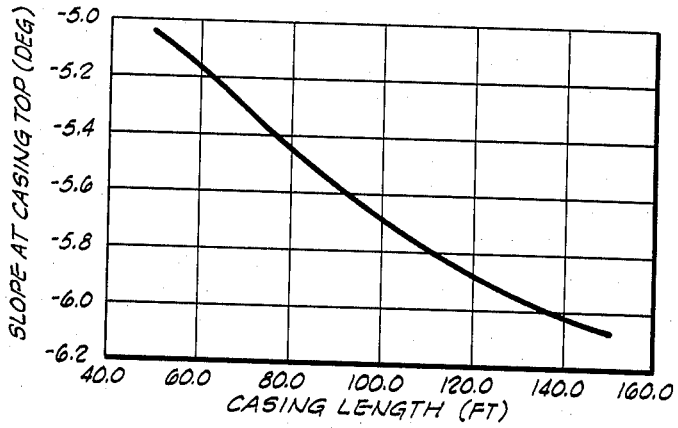
FIG. 4 graphically illustrates slope 32 as a function of casing length 50 for the assembly of FIG. 1.
Figure 5:
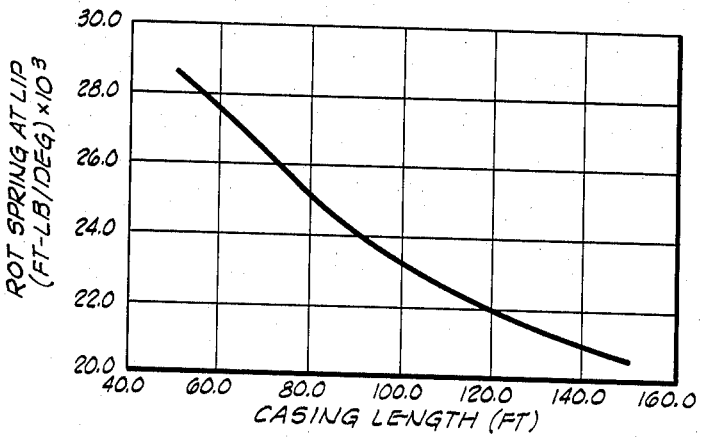
FIG. 5 graphically illustrates the rotational stiffness or spring of riser 12 at lip 22, as a function of casing length 50 for the assembly of FIG. 1.
Figure 6:
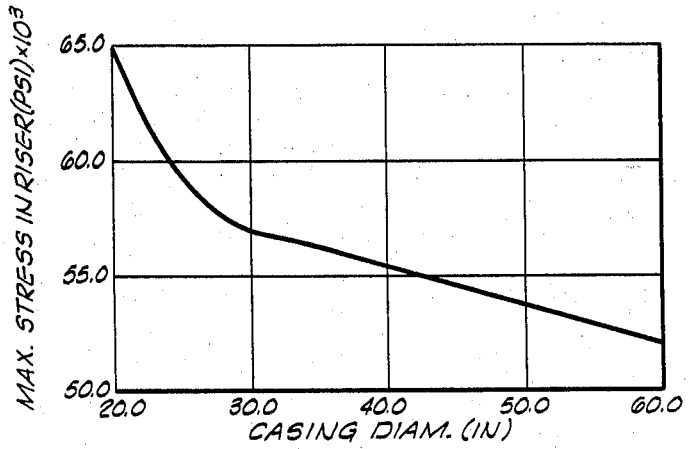
FIG. 6 graphically illustrates maximum stress in the riser as a function of the internal diameter of casing 18 for the assembly of FIG. 1.
Figure 7:
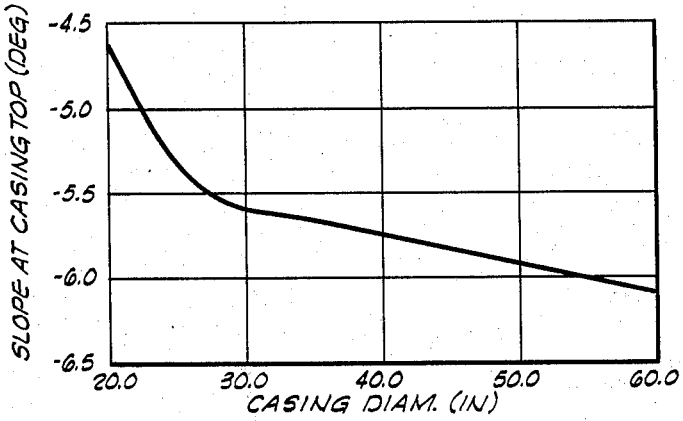
FIG. 7 graphically illustrates slope 32 as a function of the internal diameter of casing 18 for the assembly of FIG. 1.
Figure 8:
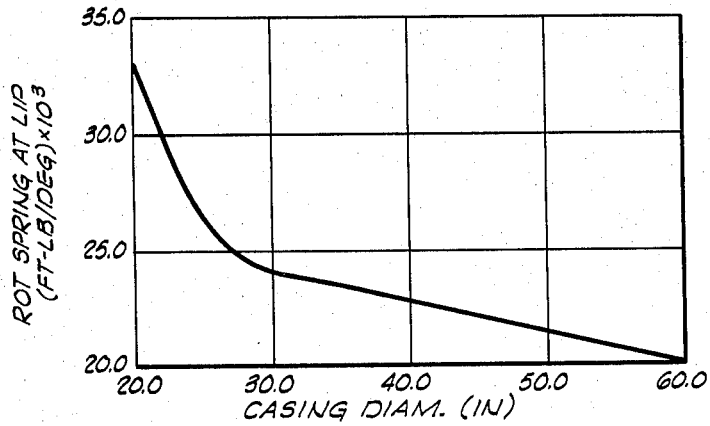
FIG. 8 graphically illustrates the rotational stiffness or spring of riser 12 at lip 22, as a function of the internal diameter of casing 18 for the assembly of FIG. 1.
Figure 3:
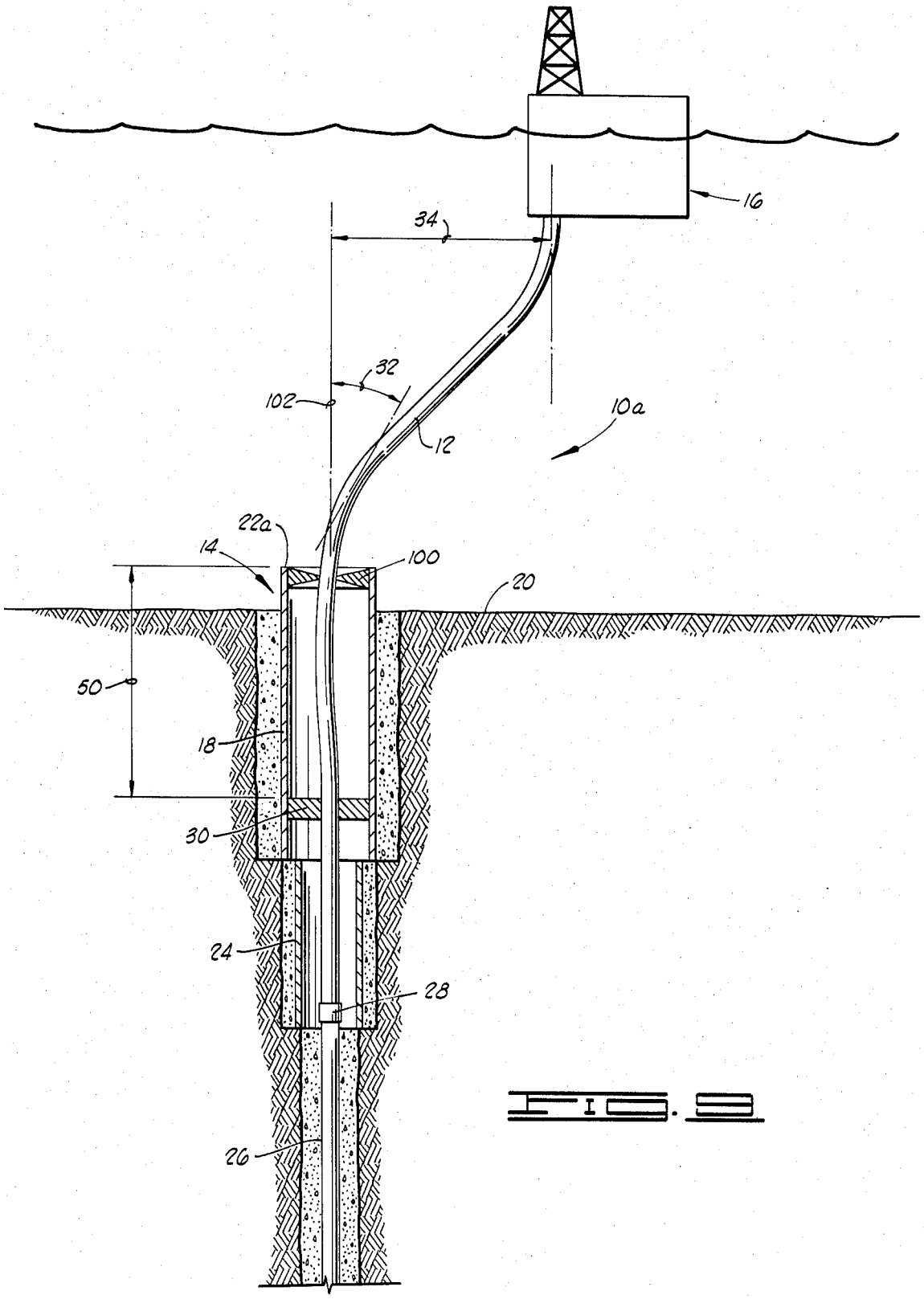
Figure 10:
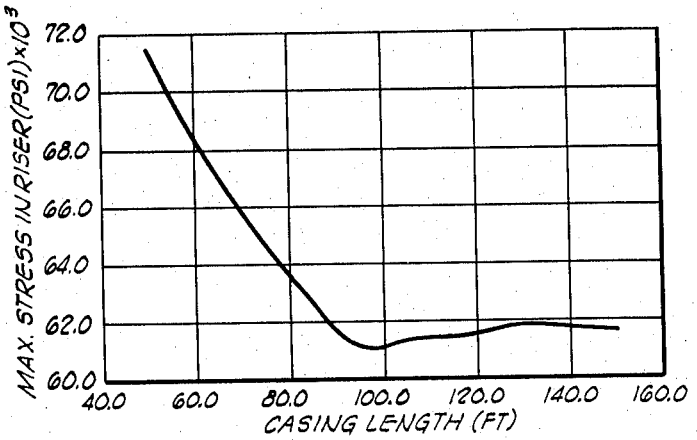
FIG. 10 graphically illustrates maximum stress in the riser as a function of casing length 50 for the alternative embodiment of FIG. 9.
Figure 11:
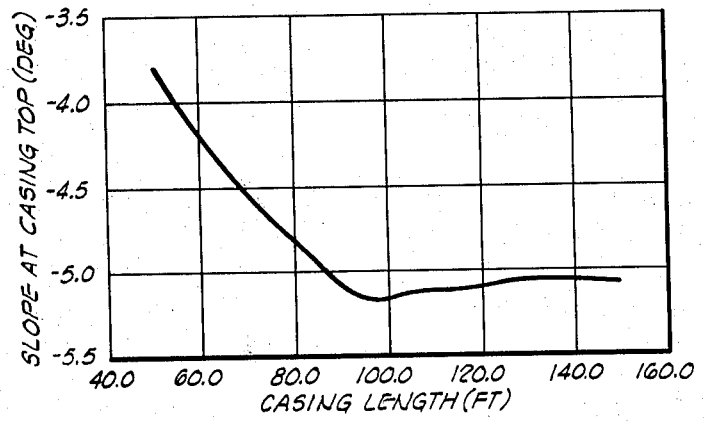
FIG. 11 graphically illustrates slope 32 as a function of casing length 50 for the alternative embodiment of FIG. 9.
Figure 12:
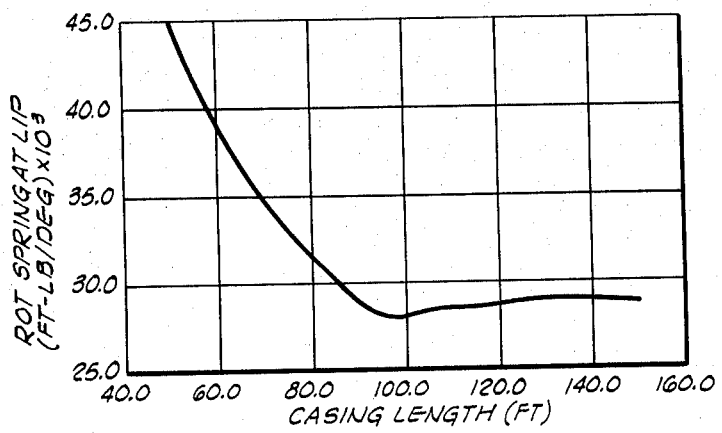
FIG. 12 graphically illustrates the rotational stiffness or spring of riser 12 at lip 22*a*, as a function of casing length 50 for the alternative embodiment of FIG. 9.
Figure 13:
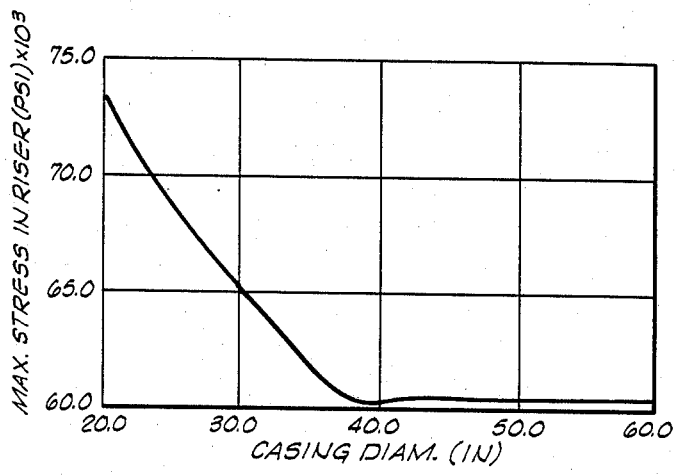
FIG. 13 graphically illustrates the maximum stress in the riser as a function of the internal diameter of casing 18 for the alternative embodiment of FIG. 9.
Figure 14:
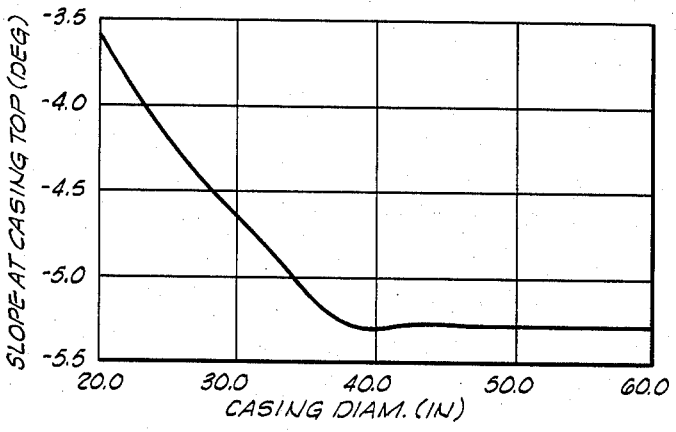
FIG. 14 graphically illustrates slope 32 as a function of the internal diameter of casing 18 for the alternative embodiment of FIG. 9.
Figure 15:
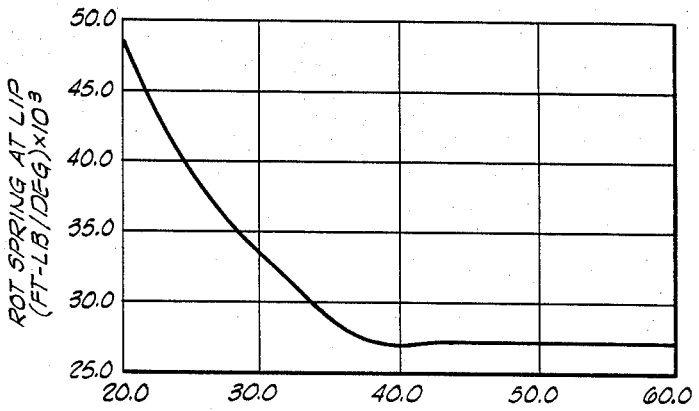
FIG. 15 graphically illustrates the rotational stiffness or spring of riser 12 at lip 22*a*, as a function of the internal diameter of casing 18 for the alternative embodiment of FIG. 9.

In FIGS. 3–5, the value of casing length 50 above hanger 30 is varied between 50 and 150 feet. In FIGS. 6–8, the value of the internal diameter of casing 18 is varied between 20 and 60 inches. For the nominal input values of all twelve variables listed above, the value of the rotational stiffness of riser 12 adjacent upper end 22 of casing 18 is approximately 23,000 ft-lb/deg.

Numerous of the variables listed above in Table #1 are dependent upon environmental conditions, e.g. current crossflow and wave size, and on various relationships between components which cannot be completely controlled, e.g. riser/casing misalignment. A minimum and maximum value of each of these factors can, however be reasonably estimated for any given installation. Somewhere within this range of each input parameter is a value which maximizes the bottom slope 32 of riser 12 and the maximum stress in riser 12. The combination of one or more of these values which maximize the bottom slope 32 and maximum stress of riser 12 are referred to as maximum design loading conditions.

For a given installation of the downhole riser assembly 10 of the present invention, the controllable parameters, e.g. riser and casing size and dimensions, must be selected so that the maximum design bottom slope 44 and maximum design maximum stress 46 (see FIG. 2) of riser 12 are not exceeded when the riser assembly 10 is subjected to maximum design loading conditions.

In summary, the riser assembly 10 includes a first tubular member or upper casing portion 18 embedded in the floor 20 of a body of water. First tubular member 18 has an upper end 22 extending above floor 20. A second tubular member or riser pipe 12 is disposed in first tubular member 18 and is rigidly connected to first tubular member 18 below the floor 20 by casing hanger 30. Second tubular member 12 has an upper end connected to floating structure 16. First tubular member 18 has a constant internal diameter above casing hanger 30. First and second tubular members 18 and 12 are so constructed that second tubular member 12 contacts the upper end 22 of first tubular member 18 when floating structure 16 is offset from first tubular member 18. The second tubular member 12 is free of laterally supporting contact with any other structure between the point of contact with upper end 22 of first tubular member 18 and a point of contact or connection with floating structure 16.

The distance 50 between upper end 22 of first tubular member 18 and the rigid connection 30 between first and second tubular members 18 and 12, and the internal diameter of first tubular member 18 are such that first tubular member 18 has a rotational stiffness, adjacent upper end 22 of first tubular member 18, within a range 48 such that both a maximum design maximum stress 46 and a maximum design bottom slope 44 of riser 12 ane not exceeded when downhole riser assembly 10 is subjected to maximum design loading conditions.

ALTERNATIVE EMBODIMENT OF FIG. 9

An alternative embodiment of the present invention is shown in FIG. 9, and is generally designated **10*a* with like numerals indicating elements similar to those of downhole riser assembly 10 of FIG. 1**.

Downhole riser assembly **10*a* differs from assembly 10 of FIG. 1 in that assembly 10*a* includes a centralizer means 100, connected between riser pipe 12 and upper casing portion 18 adjacent upper end 22*a* of upper casing portion 18. As illustrated in FIG. 9, riser pipe 12 has a constant outside diameter along its entire length. Centralizer means 100 is a means for limiting or restricting lateral movement of riser pipe 12 while allowing rotational movement of riser pipe 12 about axes perpendicular to a longitudinal axis 102 of upper casing portion 18. This rotational movement is of course only through a very small angle. While centralizer means 100 substantially prevents any lateral movement of riser pipe 12, it can be replaced with a variety of other upper connecting means or lateral support means for limiting lateral movement of riser pipe 12, which other means would allow some lateral movement short of contact with upper end 22*a* of upper casing portion 18**.

The objective of the embodiment of FIG. 9 is the same as that of FIG. 1, namely to maintain the rotational stiffness of riser pipe 12, adjacent upper end **22*a* of upper casing portion 18, within a range such that both the maximum design maximum stress and the maximum design bottom slope of riser pipe 12 are not exceeded when riser assembly 10*a*** is subjected to maximum design loading conditions.

For the nominal values of the various relevant input parameters as set forth above in Table #1, the variations in maximum stress of riser 12, bottom slope 32, and rotational stiffness of riser 12 near upper end **22*a* in response to variation of casing length 50 above casing hanger 30 and in response to variation of the internal diameter of casing 18 are illustrated in FIGS. 10–15**.

Thus, the downhole riser assembly of the present invention is well adapted to carry out the objects and attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

The embodiments of the invention in which an exclusive property or privilege is claimed are defined as follows:

1. A riser assembly, comprising:

a first tubular member, embedded in a floor of a body of water, and having an upper end extending above said floor;

a second tubular member, disposed in said first tubular member, said second tubular member being rigidly connected to said first tubular member below said floor and having an upper end connected to a structure floating on said body of water, and said first tubular member having a constant internal diameter portion extending from said rigid connection to said upper end of said first tubular member; and said first and second tubular members being so constructed that said second tubular member contacts said upper end of said first tubular member on said constant internal diameter portion thereof when said floating structure is offset from said first tubular member.

2. Apparatus of claim 1, wherein said second tubular member is free of laterally supporting contact with any other structure between said contact with said upper end of said first tubular member and said floating structure.

3. Apparatus of claim 1, wherein said upper end of said first tubular member includes an outwardly flared lip.

4. Apparatus of claim 1, wherein a distance between said upper end of said first tubular member and said rigid connection between said first and second tubular members, and said internal diameter of said constant internal diameter portion of said first tubular member are such that said second tubular member has a rotational stiffness, adjacent said upper end of said first tubular member, within a range such that both a maximum design stress and a maximum stress and a maximum design bottom slope of said second tubular member are not exceeded when said second tubular member is subjected to maximum design loading conditions.

5. Apparatus of claim 1, wherein:

said second tubular member is free of laterally supporting contact with any other structure between said contact with said upper end of said first tubular member and said floating structure; and a distance between said upper end of said first tubular member and said rigid connection between said first and second tubular members, and said internal diameter of said constant internal diameter portion of said first tubular member are such that said second tubular member has a rotational stiffness, adjacent said upper end of said first tubular member, within a range such that both a maximum design maximum stress and a maximum design bottom slope of said second tubular member are not exceeded when said second tubular member is subjected to maximum design loading conditions.

6. Apparatus of claim 5, wherein said upper end of said first tubular member includes an outwardly flared lip.

7. A downhole riser assembly, comprising:

a structure floating on a body of water;

an underwater well, including an upper casing portion embedded in a floor of said body of water and having an upper end extending above said floor, and including a lower casing portion having an outer diameter less than an inner diameter of said upper casing portion;

a riser pipe, having a lower end connected for fluid communication to said lower casing portion and having an upper end connected to said floating structure;

means for connecting said riser pipe and said upper casing portion below said floor so that said riser pipe is vertically cantilevered above said connecting means, said upper casing portion having a constant internal diameter portion extending from said connecting means to said upper end of said upper casing portion; and said upper casing portion and riser pipe being so constructed that said riser pipe contacts said upper end of said upper casing portion on said constant internal diameter portion thereof to limit lateral deflection of said riser pipe when said floating structure is offset from said underwater well.

8. Apparatus of claim 7 wherein said riser pipe is free of laterally supporting contact with any other structure between said contact with said upper end of said upper casing portion and said floating structure.

9. Apparatus of claim 7, wherein said upper end of said upper casing portion includes an outwardly flared lip.

10. Apparatus of claim 7, wherein a distance between said upper end of said upper casing portion and said connecting means, and said internal diameter of said constant internal diameter portion of said upper casing portion are such that said riser pipe has a rotational stiffness, adjacent said upper end of said upper casing portion, within a range such that both a maximum design maximum stress and a maximum design bottom slope of said riser pipe are not exceeded when said downhole riser assembly is subjected to maximum design loading conditions.

11. Apparatus of claim 7, wherein:

said riser pipe is free of laterally supporting contact with any other structure between said contact with said upper end of said upper casing portion and said floating structure; and a distance between said upper end of said upper casing portion and said connecting means, and said internal diameter of said constant internal diameter portion of said upper casing portion are such that said riser pipe has a rotational stiffness, adjacent said upper end of said upper casing portion, within a range such that both a maximum design maximum stress and a maximum design bottom slope of said riser pipe are not exceeded when said downhole riser assembly is subjected to maximum design loading conditions.

12. Apparatus of claim 11, wherein said upper end of said upper casing portion includes an outwardly flared lip.

13. A riser assembly, comprising:

a first tubular member, embedded in a floor of a body of water, and having an upper end extending above said floor;

a second tubular member, disposed in said first tubular member, said second tubular member being rigidly connected to said first tubular member below said floor and having an upper end connected to a structure floating on said body of water; and lateral support means, connected between said first and second tubular members adjacent said upper end of said first tubular member for limiting lateral movement of said second tubular member;

wherein said first tubular member has a constant internal diameter portion between said rigid connection and said lateral support means; and wherein said second tubular member has a constant outside diameter portion extending from said rigid connection to said lateral support means.

14. Apparatus of claim 13, wherein said lateral support means is further characterized as a centralizer means for preventing lateral movement of said second tubular member while allowing rotational movement of said second tubular member about axes perpendicular to a longitudinal axis of said first tubular member.

15. Apparatus of claim 13, wherein said second tubular member is free of laterally supporting contact with any other structure between said lateral support means and said floating structure.

16. Apparatus of claim 13, wherein a distance between said upper end of said first tubular member and said rigid connection between said first and second tubular members, and said internal diameter of said constant internal diameter portion of said first tubular member are such that said second tubular member has a rotational stiffness, adjacent said lateral support means, within a range such that both a maximum design maximum stress and a maximum design bottom slope of said second tubular member are not exceeded when said second tubular member is subjected to maximum design loading conditions.

17. Apparatus of claim 13, wherein:

said second tubular member is free of laterally supporting contact with any other structure between said lateral support means and said floating structure; and a distance between said upper end of said first tubular member and said rigid connection between said first and second tubular members, and said internal diameter of said constant internal diameter portion of said first tubular member are such that second tubular member has a rotational stiffness, adjacent said lateral support means, within a range such that both a maximum design maximum stress and a maximum design bottom slope of said second tubular member are not exceeded when said second tubular member is subjected to maximum design loading conditions.

18. A downhole riser assembly, comprising:

a structure floating on a body of water;

an underwater well, including an upper casing portion embedded in a floor of said body of water and having an upper end extending above said floor, and including a lower casing portion having an outer diameter less than an inner diameter of said upper casing portion;

a riser pipe, having a lower end connected for fluid communication to said lower casing portion and having an upper end connected to said floating structure;

lower connecting means for connecting said riser pipe and said upper casing portion below said floor so that said riser pipe is vertically cantilevered above said lower connecting means; and a centralizer means, connected between said riser pipe and said upper casing adjacent said upper end of said upper casing portion, for substantially preventing lateral movement of said riser pipe while allowing rotational movement of said riser pipe about axes perpendicular to a longitudinal axis of said upper casing portion;

wherein said upper casing portion has a constant internal diameter portion between said lower connecting means and said centralizer means; and wherein said riser pipe has a constant outside diameter portion extending from said lower connecting means to said lateral support means.

19. Apparatus of claim 18, wherein said riser pipe is free of laterally supporting contact with any other structure between said centralizer means and said floating structure.

20. Apparatus of claim 18, wherein a distance between said upper end of said upper casing portion and said lower connecting means, and said internal diameter of said constant internal diameter portion of said upper casing portion are such that said riser pipe has a rotational stiffness, adjacent said centralizer means, within a range such that both a maximum design maximum stress and a maximum design bottom slope of said riser pipe are not exceeded when said downhole riser assembly is subjected to maximum design loading conditions.

21. Apparatus of claim 18, wherein:

said riser pipe is free of laterally supporting contact with any other structure between said centralizer means and said floating structure; and a distance between said upper end of said upper casing portion and said lower connecting means, and said internal diameter of said constant internal diameter portion of said upper casing portion are such that said riser pipe has a rotational stiffness, adjacent said centralizer means, within a range such that both a maximum design maximum stress and a maximum design bottom slope of said riser pipe are not exceeded when said downhole riser assembly is subjected to maximum design loading conditions.

* * * * *